US006936139B2

(12) United States Patent
Watanabe

(10) Patent No.: US 6,936,139 B2
(45) Date of Patent: Aug. 30, 2005

(54) SHOE PRESS APPARATUS OF A PAPERMAKING MACHINE

(75) Inventor: Kazumasa Watanabe, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 267 days.

(21) Appl. No.: 10/353,634

(22) Filed: Jan. 29, 2003

(65) Prior Publication Data

US 2003/0145971 A1 Aug. 7, 2003

(30) Foreign Application Priority Data

Feb. 6, 2002 (JP) ..... 2002-029755

(51) Int. Cl.[7] ..... D21F 3/02

(52) U.S. Cl. ..... 162/358.3; 162/272; 100/153; 100/156

(58) Field of Search ..... 162/204–207, 162/358.1, 358.3, 358.4, 358.5, 359.1, 360.3, 901, 199, 272; 492/7, 20; 100/118, 121, 153, 156, 160, 170, 176

(56) References Cited

U.S. PATENT DOCUMENTS 5,110,417 A * 5/1992 Lehtonen et al. ..... 162/358.3
5,302,252 A * 4/1994 Gotz ..... 162/358.5
5,843,283 A * 12/1998 Henssler et al. ..... 162/358.3
5,935,385 A * 8/1999 Grabscheid et al. ..... 162/358.3
5,951,824 A * 9/1999 Deshpande ..... 162/358.3
5,997,695 A * 12/1999 Ilmarinen ..... 162/358.3
6,083,352 A * 7/2000 Snellman et al. ..... 162/358.3
6,139,691 A * 10/2000 Brox ..... 162/358.3

FOREIGN PATENT DOCUMENTS

| | | |
|---|---|---|
| JP | 64-33293 | 2/1989 |
| JP | 2-41486 | 2/1990 |
| JP | 9-503561 | 4/1997 |
| JP | 10-131075 | 5/1998 |
| WO | WO 00/24965 | 5/2000 |

* cited by examiner

*Primary Examiner*—Eric Hug
(74) *Attorney, Agent, or Firm*—Howson and Howson

(57) ABSTRACT

In a shoe press apparatus of a papermaking machine, a press part comprises a roll which serves as a pressing member and a shoe. A belt is sandwiched between the roll and the shoe. A lubricant feeder supplies a lubricant from the outside of the shoe at the upstream side of the shoe. A lubricant holding section, comprising a plurality of grooves is provided on the upstream end of the shoe. Lubricant supplied from the lubricant feeder is held in the lubricant holding section of the shoe, and is more reliably supplied to the press part as the belt runs through the press part. The Structure of the lubricant holding section is comparatively simple, and the lubricant holding section decreases friction, thereby saving energy.

8 Claims, 9 Drawing Sheets

SHOE PRESS APPARATUS OF A PAPERMAKING MACHINE

FIELD OF THE INVENTION

This invention relates to improvements in the shoe press apparatus of a papermaking machine, and more particularly to improvements which decrease the friction generated between the shoe and a belt.

BACKGROUND OF THE INVENTION

In the past, in the press and calendar stages of a papermaking process, a paper material was typically compressed between a pair of press rolls. However, the press rolls apply pressure to the paper material only along a narrow line. Therefore, it was difficult to increase the amount of water squeezed out of the paper material in the press part. Moreover, since the paper material is flattened at the calendar part, undesirable effects are occasionally produced on the manufactured paper. To avoid these characteristic problems, there has been a trend toward the use of a shoe press apparatus, wherein a press roll cooperates with a shoe the surface of which conforms to the outer surface of the press roll. The use of the shoe press apparatus has been growing recently, and it has come into widespread use.

FIGS. 7–9 show conventional shoe press apparatuses used in a press stage of a papermaking machine, and FIG. 10 shows a conventional shoe press apparatus used in the calendar stage. Shoe press apparatuses 100*a* and 100*b*, shown in FIGS. 7 and 8 respectively, utilize a press part P comprising a press roll R and a shoe S. A wet paper web W, a pair of felts F pinching the wet paper web W, and a belt B, are provided in the press part P. With the rotation of the press roll R, the wet paper web W, the felts F, and the belt B, run through the press part P. The arrow MD ("machine direction") shows the direction of the rotation of the press roll R.

In many cases, a belt B is manufactured by impregnating a base body comprising a woven fabric, etc., with resin, in order to impart strength to the belt. Depending on the structure of the shoe press apparatus, a relatively long belt, as in FIG. 7, or a short belt, as in FIG. 8, may be adopted.

The shoe press apparatus 10*d*, used in a calendar part shown in FIG. 10, has a structure corresponding to that of the press part shown in FIG. 8, but with the press roll R replaced by a calendar roll R'. A calendar belt BC and paper material W', having a rough surface, are sandwiched by the press part P comprising the calendar roll R' and a shoe S.' The belt BC and the paper material W' pass through the press part P with the rotation of the calendar roll R'. The calendar belt BC differs in exactness from a press part belt B. However, both belts have the same basic structure, consisting of a base body and a resin.

Next, a shoe press apparatus 100*c* of FIG. 9 does not use a press roll. Instead, its press part P comprising a pair of shoes Sa and Sb. This shoe press apparatus is disclosed in Unexamined Japanese Patent Publication No. 131075/1998. In shoe press apparatus 100*c*, a wet paper web (not shown), a pair of felts F, pinching the wet paper web, and a pair of belts, Ba and Bb, pass through the press part P, between the pair of shoes Sa and Sb. Belt Ba is a driven belt.

In these shoe press apparatuses, it is important to decrease the friction generated between the shoe and the belt while the belt is running. In the shoe press apparatuses 100*a*, 100*b*, and 100*d*, shown in FIGS. 7, 8, and 10, the belts B and BC rotate along with the rotation of the press roll R or the calendar roll R'. Moreover, in the shoe press apparatus 100*c* of FIG. 9, the belt Bb rotates along with the driven belt Ba. Decreasing the friction generated between the belts and the shoes will reduce the energy consumed in driving the press roll R, the calendar roll R', or the driven belt Ba.

Therefore, it is conventional practice to supply a lubricant between a belt and a shoe to decrease the friction generated between them. Oil is usually used as a lubricant, but water or other fluid also may be used.

FIGS. 11–14 show conventional shoe press apparatuses having lubricant supply structures. FIG. 11 is a partial cross-sectional view of a shoe press apparatus 100*e*, disclosed in Unexamined PCT National Phase Publication No. 503561/1997. This shoe press apparatus 100*e* has a lubricant feeder OS, located on the upstream side of a shoe S, and supplying a lubricant between the shoe S and a belt B from the outside of the shoe S in response to a controller.

In this shoe press apparatus 100*e*, the curvature of the surface of the shoe S differs from that of the press roll R so that a hollow space is provided between the shoe S and the roll R, and a lubricant supplied from outside of the shoe S can accumulate between the shoe S and the belt B.

FIG. 12 is a partial cross-sectional view of a shoe press apparatus 100*f*, disclosed in Unexamined PCT International Publication No. WO 00/24965. A concave part 60 is provided in the upper surface of a shoe S, and a supply passage 62, for supplying a lubricant to the concave part 60, is provided in the shoe S, leading from underneath the shoe to the concave part. Therefore, this shoe press apparatus 100*f* supplies a lubricant between the belt B and shoe S from the inside of the shoe S. In this connection, although a shoe S comprising two members, S' and S", is shown in FIG. 12, the shoe may alternatively be composed of a unitary member.

Shoe press apparatus 100*g*, shown in FIG. 13, is another example in which a lubricant is supplied between a shoe and a belt from the inside of the shoe. This shoe press apparatus 100*g* is disclosed in Unexamined Japanese Patent Publication No. 41486/1990. Two concave parts, 60*a* and 60*b*, are formed on the upper surface of the shoe S, and a lubricant is supplied to these concave parts through supply passage 62*a* and 62*b* respectively, both supply passages being provided inside the shoe S. Lubricant supplied to the concave part 60*a* provided in the center of the shoe S of this shoe press apparatus 100*g* also functions to apply pressure to the belt B.

FIG. 14 shows a shoe press apparatus 100*h* disclosed in Unexamined Japanese Patent Publication No. 33293/1989. In this shoe press apparatus, a guide member SA, which may move in an axial direction, is provided on a shoe S, and a lubricant feeder OS is provided on the upstream of the guide member SA. In this shoe press apparatus 100*h*, although the guide member SA is not pressed by a press roll, it forms the introduction part of the shoe S and may therefore be considered a member forming a part of the shoe S.

As described in the above, there are several kinds of conventional shoe press apparatus, either supplying a lubricant from the outside of the shoe S as shown in FIG. 11, or supplying a lubricant from the inside of the shoe S as shown in FIGS. 12–14. All of these shoe press apparatuses are subject to several problems. In the case in which lubricant is supplied from the outside of the shoe S, it is difficult to supply the lubricant to the area between the shoe S and belt B, since the gap between the shoe and belt is narrow, and lubricant is supplied where the shoe is in contact with the belt. Therefore, although lubricant is supplied continuously as a jet so that more lubricant may be supplied between the shoe S and belt B, it is difficult to achieve adequate lubrication since the lubricant tends to drop off before reaching the space between the shoe S and the belt B, due to factors such as the shape of the end of the shoe S.

On the other hand, in the case in which lubricant is supplied through the shoe, there is a different problem. Even though a sufficient quantity of lubricant is supplied to the interface between the belt and the shoe on the downstream side of the concave part of the shoe, little, if any lubricant is supplied to the upstream side. Moreover, although the apparatus shown in FIG. 13 partially solve this problem by supplying a lubricant at two points its manufacturing cost is relatively high since the interior structure of the shoe, and the structure of related components, are complex.

SUMMARY OF THE INVENTION

The shoe press apparatus in accordance with the invention has a press part comprising a shoe, a pressing member cooperating with, and in opposed relationship to, the shoe, a belt sandwiched in the press part between the shoe and the pressing member and movable relative to said shoe in a first direction from an upstream side of the shoe toward a downstream side of the shoe. The belt is arranged to come into contact with the shoe at a location on the upstream side, and a lubricant supply means is arranged to supply lubricant to the shoe and belt on the upstream side of the shoe. The improvement comprises a lubricant holding section formed in the surface of the shoe at least in part on the upstream side of said location.

The lubricant holding section may be provided in an area of the shoe that is not contacted by said belt. Alternatively, part of the lubricant holding section may be provided in an area that is not contacted by the belt while a part of the lubricant holding section is provided in an area that is contacted by said belt.

The lubricant holding section may comprises a plurality of minute concavities, or one or more grooves. In the case of a groove, the groove can become shallow, or wider, or both shallower and wider, toward its downstream end. The upstream end of the groove may have an opening, or may be closed. The lubricant held in the lubricant holding section of the shoe is reliably supplied to the press part, between the shoe and the belt, along substantially the entire area over which the belt and shoe are in contact with each other while the papermaking machine is operating. Consequently, the lubricant decreases the friction between the belt press shoe to a greater degree than in conventional shoe presses.

BRIEF DESCRIPTION OF DRAWINGS

FIG. 1(*b*) is a partial perspective view showing the upstream side of a shoe;

FIG. 2(*b*) is a partial cross-sectional view of the upstream part of a press part corresponding to FIG. 1, wherein a part of a lubricant holding section is provided in a portion of the shoe that is not contacted by the belt, and another part of the lubricant holding section is provided in a portion of the shoe that is contacted by the belt;

FIG. 5(*b*) is schematic cross-sectional view of the shoe of FIG. 5(*a*);

DETAILED DESCRIPTION OF THE PREFERRED EMBODIMENTS

Figure 1A:
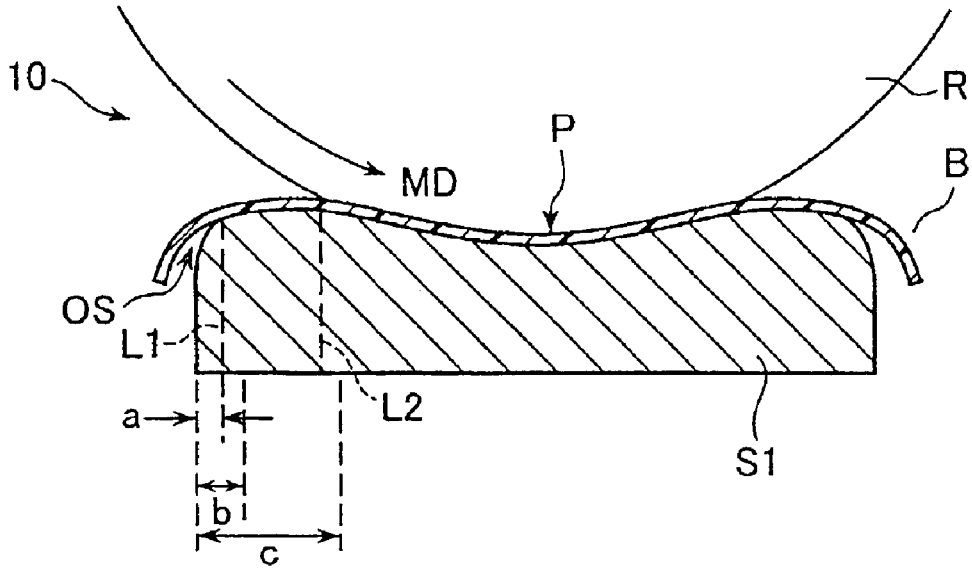
FIG. 1(*a*) is a partial sectional view of the press part of a papermaking shoe press apparatus according to an embodiment of the invention.
Figure 1B:
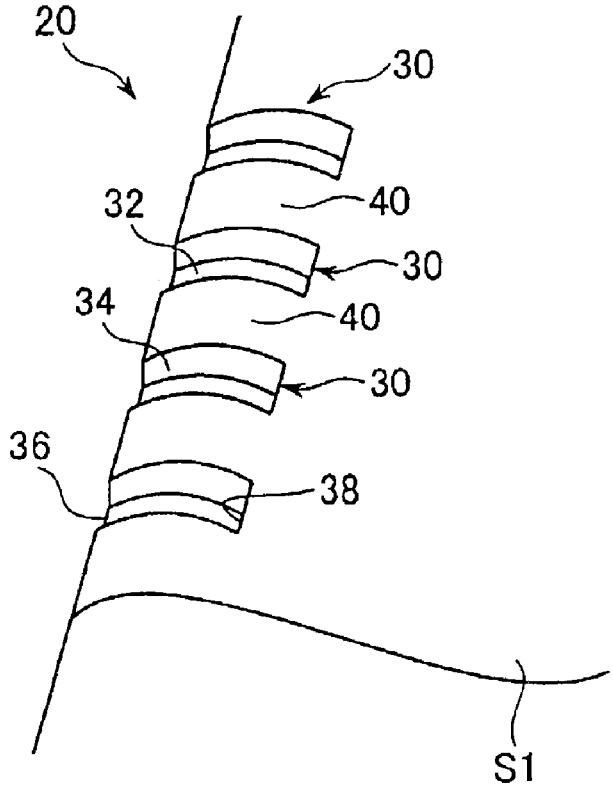

In the shoe press apparatus 10 shown in FIG. 1(*a*), which may be a either a press or a calendar, the press part P comprises a roll R, serving as a pressing member, and a shoe S1, the shape of which conforms to the outer surface of the roll R. A conventional press roll or calendar roll may be used as the roll R. Paper material (not shown), and a belt-shaped body such as a pair of felts (not shown) for pinching the paper material, are pinched in the press part P along with a belt B. When the roll R rotates in the direction of arrow MD, the paper material, the felts, and the belt B pass through the press part P.

Figure 11:
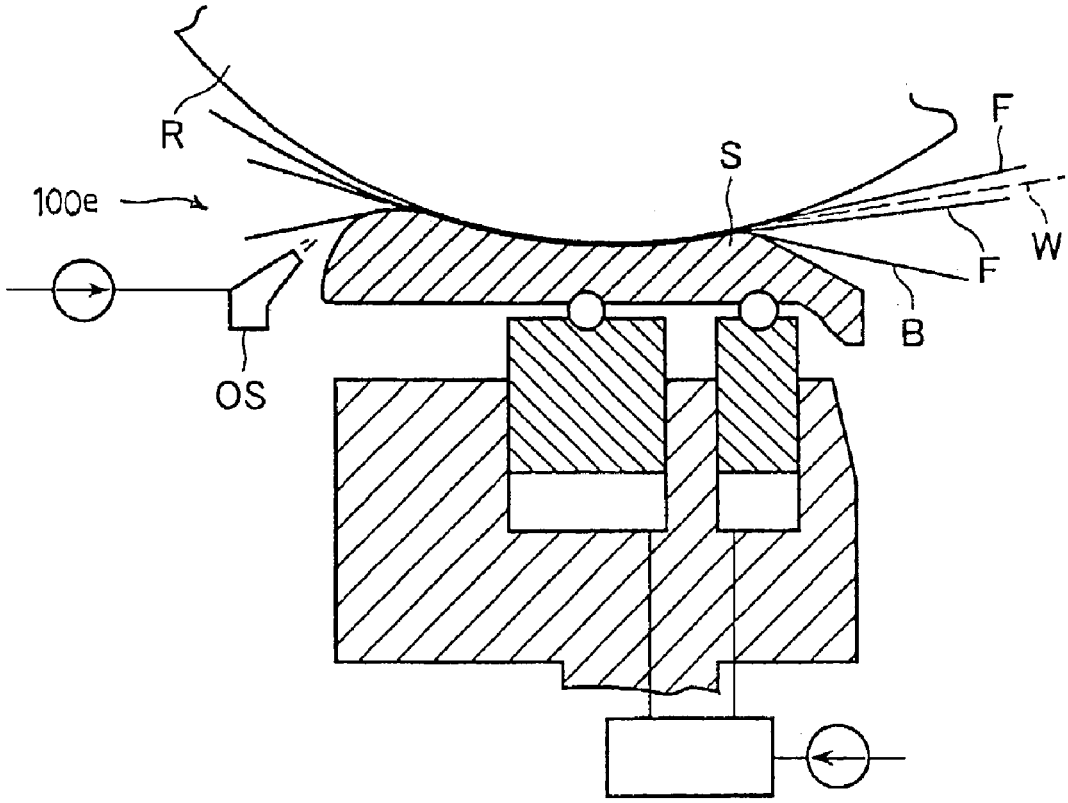
FIG. 11 is a partial cross-sectional view of a conventional shoe press apparatus having a lubricant supply structure upstream of the shoe.

A lubricant feeder OS, supplying a lubricant between the belt B and the shoe S1 is provided upstream of the shoe press apparatus 10, the term "upstream" referring to a location of a portion of the belt just before it enters the press part of the machine in the running direction of the machine, i.e. the machine direction MD. The lubricant feeder shown in FIG. 11 may be used as the lubricant feeder OS.

As shown in FIG. 1(*b*), a lubricant holding section 20 is provided on the upstream end of the shoe. Grooves 30, each comprising a bottom 32, sides 34, a front opening 36, and a back wall .38, are provided in the upstream end of the shoe S1. The grooves 30 are disposed in parallel relationship along the upstream end of the shoe, and lands 40 are formed between the grooves. Although not illustrated in FIG. 1(*b*), the edges of the grooves 30 are rounded off.

A lubricant, supplied between the belt B and the shoe S1, is held between the grooves 30 and the belt B, as well as in an area where the belt B is in contact with the land 40. The lubricant held between the belt B and the lands 40, or between the grooves 30 and the belt B, is drawn into the press part P (between the belt B and the shoe S1) by the running of the belt B. A part of the lubricant supplied between the belt B and the lands 40 may drop off occasionally as in the case of a conventional shoe press lubricated from the upstream side. However, the lubricant supplied between the grooves 30 and the belt B is more reliably drawn into the press part P by the running of the belt B, and consequently more lubricant is supplied to the press part P than before.

In the shoe press apparatus 10 according to the invention less friction is generated between the belt B and the shoe S than in the case of a conventional shoe press. Consequently less energy is required to drive the belt, and the energy required for rotating and driving the roll R is decreased. The location of the lubricant holding section 20 of shoe S1 will be explained referring to FIG. 1(*a*). L1 is the location where the belt B comes into contact with the shoe S1, and L2 is the location of the upstream end of the of the press part P, where the roll R and shoe S begin to apply pressure to the belt. As shown diagramatically in FIG. 1(*a*), the lubricant holding section may be provided in any of three areas: an area a which extends from an upstream location, where the shoe S is not in contact with the belt B, to the location L1; an area b, which extends from an upstream location where the shoe S is not in contact with the belt B to a location downstream of location L1; and an area c which extends from an upstream location where the shoe S is not in contact with the belt B to the location which is either coincident with, or on the downstream side of, location L2.

Figure 2A:
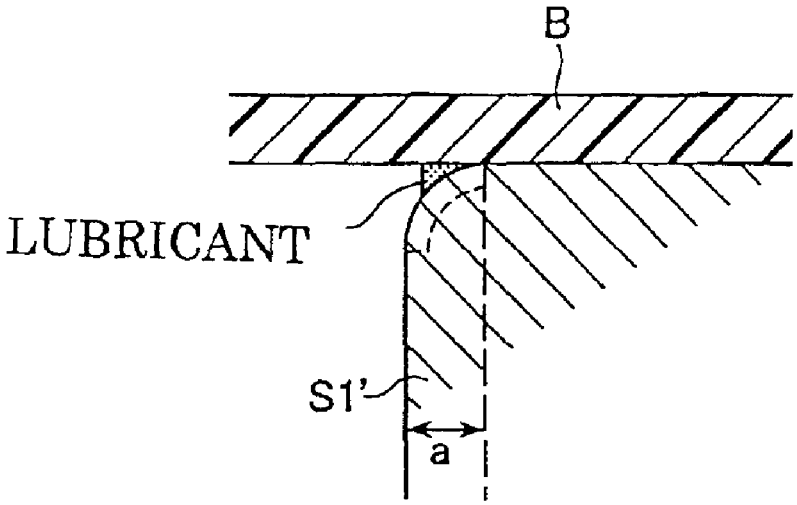
FIG. 2(*a*) is a partial cross-sectional view of the upstream part of a press part corresponding to FIG. 1, wherein a lubricant holding section is provided in a portion of the shoe that is not contacted by the belt.
Figure 2B:
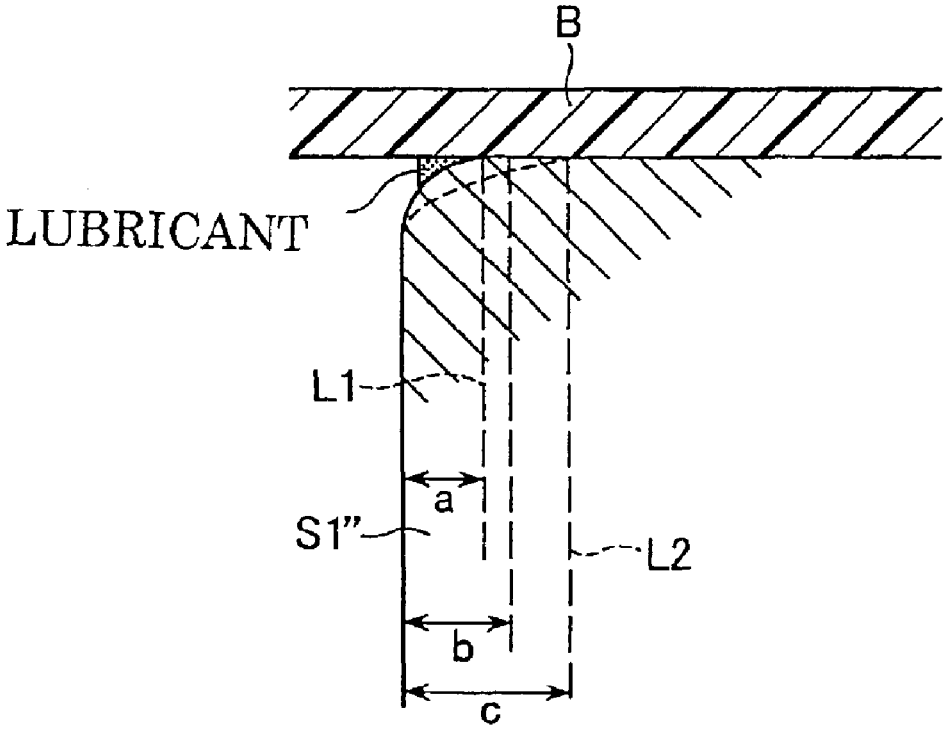

FIG. 2(*a*) shows a case where the lubricant holding section 20 is provided in the above-mentioned area a, and FIG. 2(*b*) shows a case where the lubricant holding section 20 is provided in the above-mentioned area c. In the case where the lubricant holding section 20 is in area a, as shown in FIG. 2(*a*), lubricant can be reliably supplied to the press part P, since the lubricant is held in shoe S1" immediately upstream of the location at which the belt B comes into contact with the shoe. On the other hand, where the lubricant holding section 20 is provided in the above-mentioned area c, as shown in FIG. 2(*b*), lubricant may be held in the area where the belt B is in contact with the shoe S1", as well as immediately upstream of the location at which the belt B comes into contact with the shoe S1". Moreover, when the lubricant holding section 20 is in area b, and also when it is in area c, lubricant will be held in an area where the belt B is in contact with the shoe S1". Therefore, in these cases, lubricant is also reliably supplied to the press part P. The choice of which of the areas a, b, and c the lubricant holding section 20 is provided in is made according to the inclination of the rounded-off edge of the shoe S1 and the location where the belt B comes in contact with the shoe, the contact angle between the belt B and the shoe S1, and the distance between the contact starting location L1 and the upstream end L2 of the press part It is not necessary that the grooves forming the lubricant holding section be uniform in depth or that they have a back wall.

Figure 3:
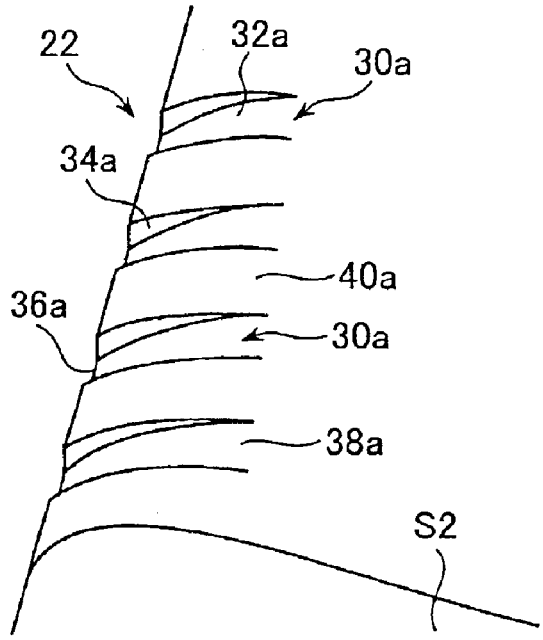
FIG. 3 is a partial perspective view of a shoe in accordance with another embodiment of the invention.

In the embodiment shown in FIG. 3, a lubricant holding section 22, on a shoe S2, is composed of grooves 30*a*, each having a bottom 32*a*, sides 34*a*, a front opening 36*a*, and a back 38*a*. Lands 40*a*, which extend in the running direction of the belt over the shoe, are provided between the grooves at the upstream end of the shoe. The depths of these grooves 30*a* gradually becomes shallow from the front opening 36*a* toward the back 38*a*. The shoe S2 of this embodiment tends to maintain a more stable running condition, since the difference in level between the lands 40*a* and the bottoms of the grooves is small at the location where the belt B comes into contact with the shoe.

Figure 4:
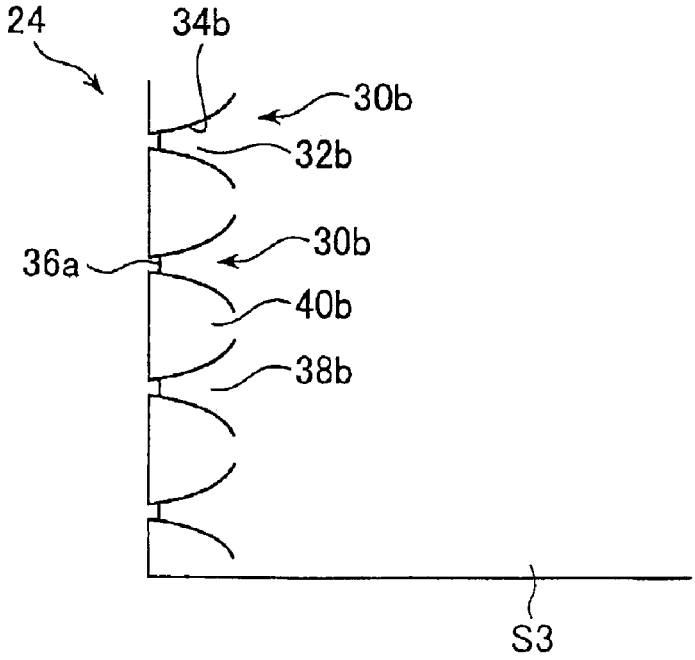
FIG. 4 is a partial top plan view of a shoe in accordance with still another embodiment of the invention.

In FIG. 4, a lubricant holding section 24 comprises grooves 30*b*, each of which has a bottom 32*b*, sides 34*b*, a front opening 36*b*, and a back 38*b*. Lands 40*b* are formed between the grooves. As in the shoe of FIG. 3, the depths of each of the grooves 30*b* in FIG. 4 gradually becomes shallow from the front opening 36*b* toward the back 38*b*. The back 38*b* of each groove is wider than its front opening 36*b*. The lubricant holding section 24 of this embodiment can supply more lubricant into the press part P, since more lubricant is held where the belt B is in contact with the shoe S3. On the other hand, as an alternative, in the lubricant holding section the width of the back of each groove may be narrower than the width of its front opening. In this case, friction generated where the belt B comes into contact with the shoe cab be decreased.

Figure 5A:
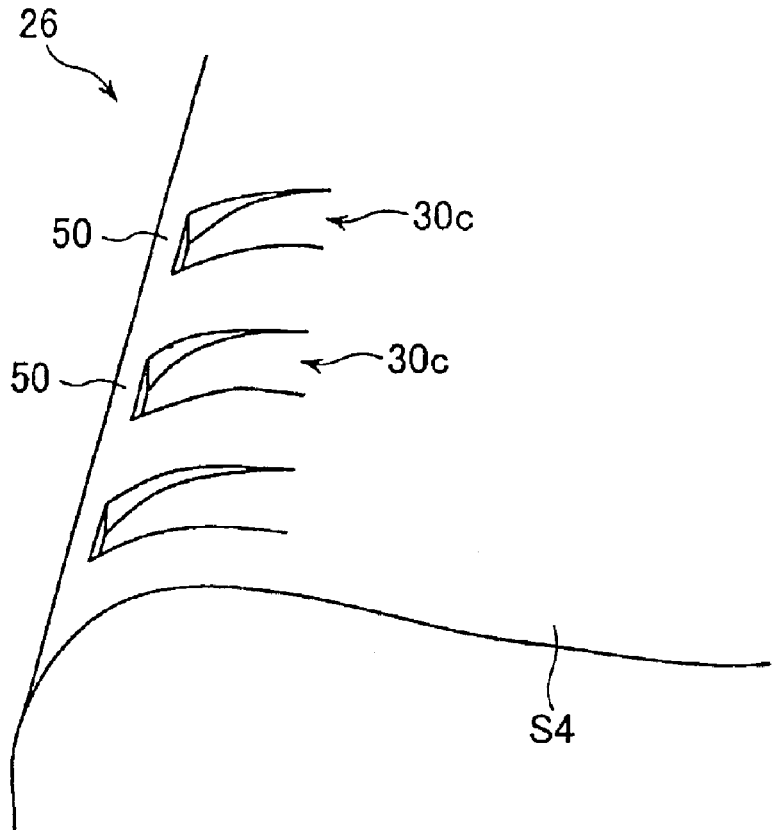
FIG. 5(*a*) is a partial perspective view of a shoe in accordance with a further embodiment of the invention.
Figure 5B:
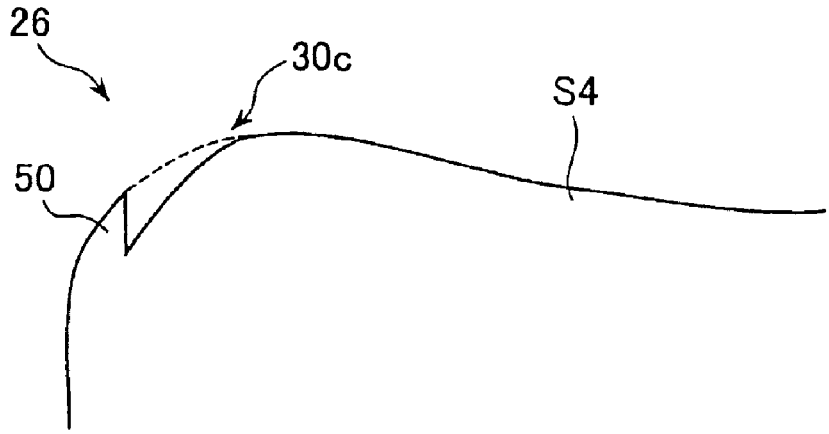

In the embodiment illustrated in FIGS. 5(*a*) and 5(*b*), a lubricant holding section 26 comprises grooves 30*c* wherein a wall 50 is provided instead of a front opening as in the embodiment of FIG. 3. The wall structure dams up lubricant, preventing it from dropping off the groove 30*c*. Since lubricant is always held in the groove 30*c*, more lubricant may be supplied continuously between a belt and shoe S4.

Figure 6:
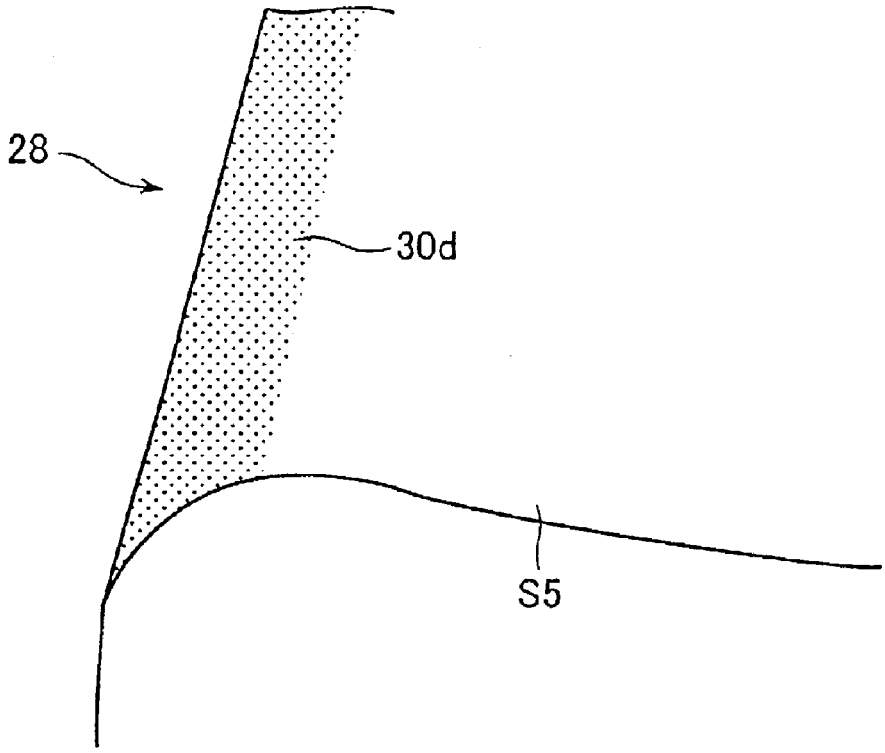
FIG. 6 is a partial perspective view of a shoe having a lubricant holding section which is not composed of grooves.
Figure 7:
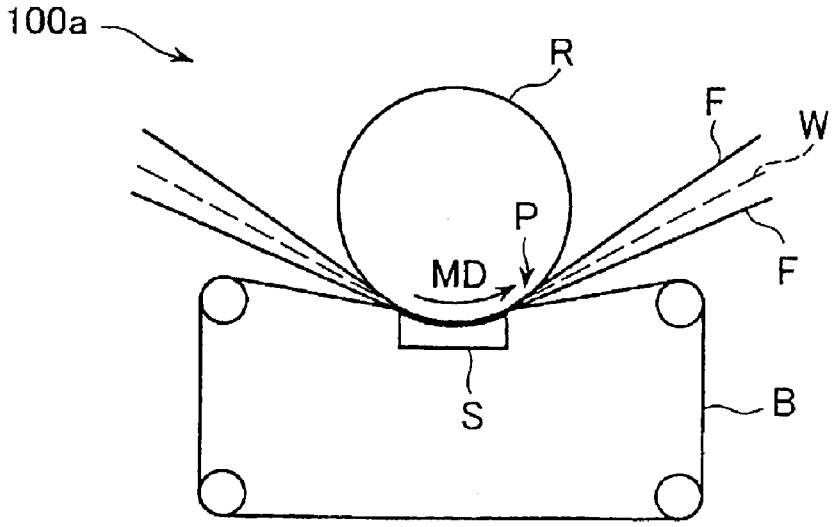
FIG. 7 is a schematic elevational view of a first conventional shoe press apparatus.
Figure 8:
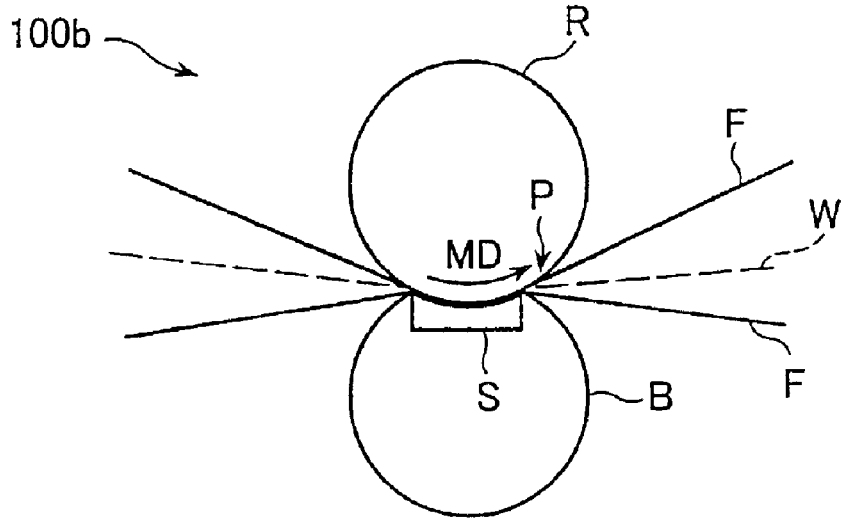
FIG. 8 is a schematic elevational view of a second conventional shoe press apparatus.

The lubricant holding section is not necessarily grooved. For example, in FIG. 6 a shoe S5 has, at its upstream end, a lubricant holding section 28 comprising many minute concavities 30*d* (usually called a "satin finish" in machining). In this case, a large amount of lubricant supplied from the outside to the shoe S5 can be held in the multitude of minute concavities 30*d*, and therefore a large amount of lubricant can be supplied continuously between a belt and shoe S5.

Figure 12:
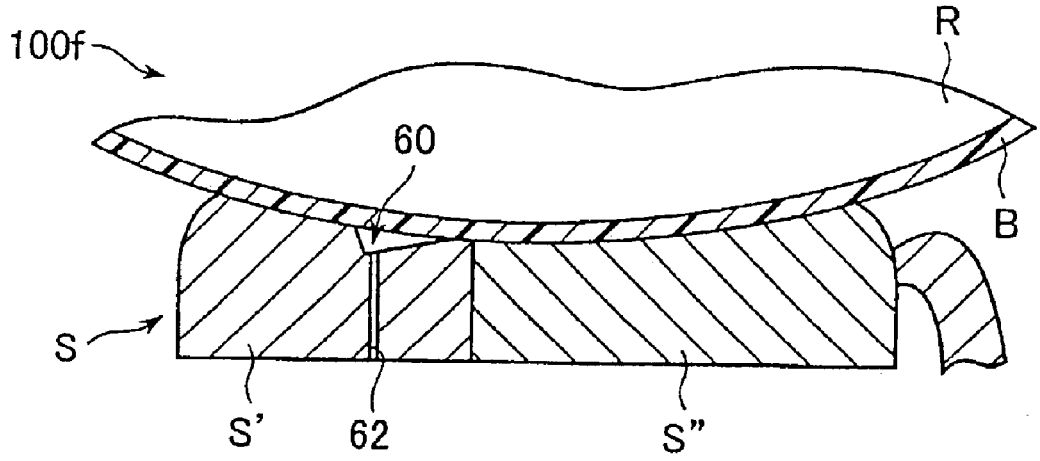
FIG. 12 is a partial cross-sectional view of another conventional shoe press apparatus having a lubricant supply structure within the shoe.
Figure 13:
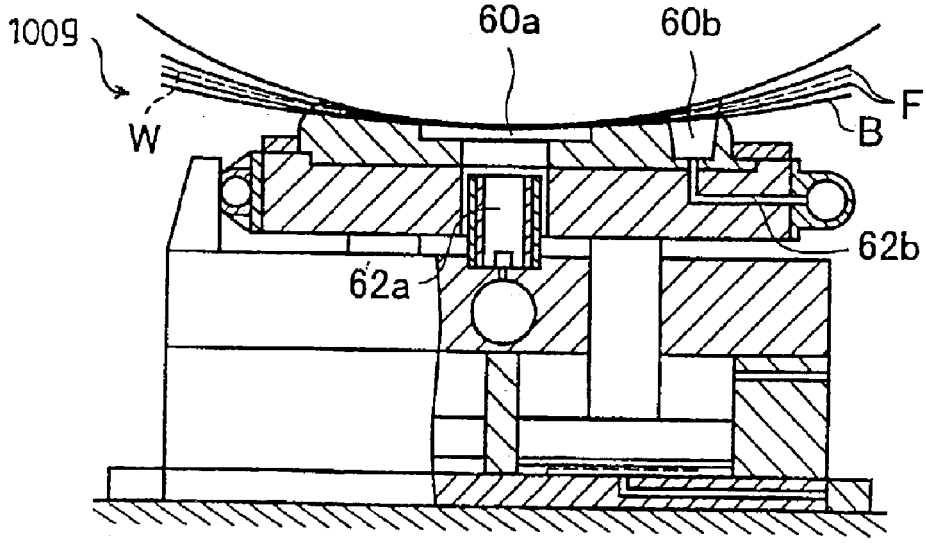
FIG. 13 is a partial cross-sectional view of another conventional shoe press apparatus having a lubricant supply structure within the shoe.
Figure 14:
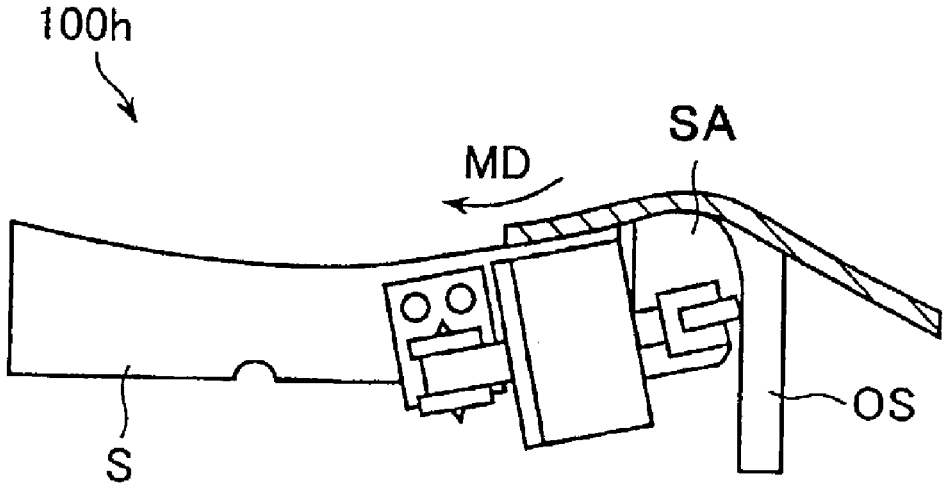
FIG. 14 is a partial cross-sectional view of still another conventional shoe press apparatus having a lubricant supply structure.

In a shoe press apparatus according to the invention, the above-described lubricant holding sections 20, 22, 24, 26 and 28 may be provided shoes of various shapes. In this case, the structure of the lubricant holding sections, and the positions where the lubricant holding sections are provided, differ according to the shape of the shoe, so that lubricant supplied from the outside of the shoe can be held most effectively. Therefore, it is necessary to provide lubricant holding sections of a suitable structure, and in a suitable position, for the shape of a shoe. For instance, when a shoe comprises a plurality of members as in the case of the conventional shoe press apparatus shown in FIG. 12, a lubricant holding section may be provided in the shoe member on the upstream side of the apparatus. Moreover, when an auxiliary member, such as a guide member corresponding to guide member SA in FIG. 14, is provided at the upstream of a shoe a lubricant holding section may be provided in this auxiliary member.

Figure 9:
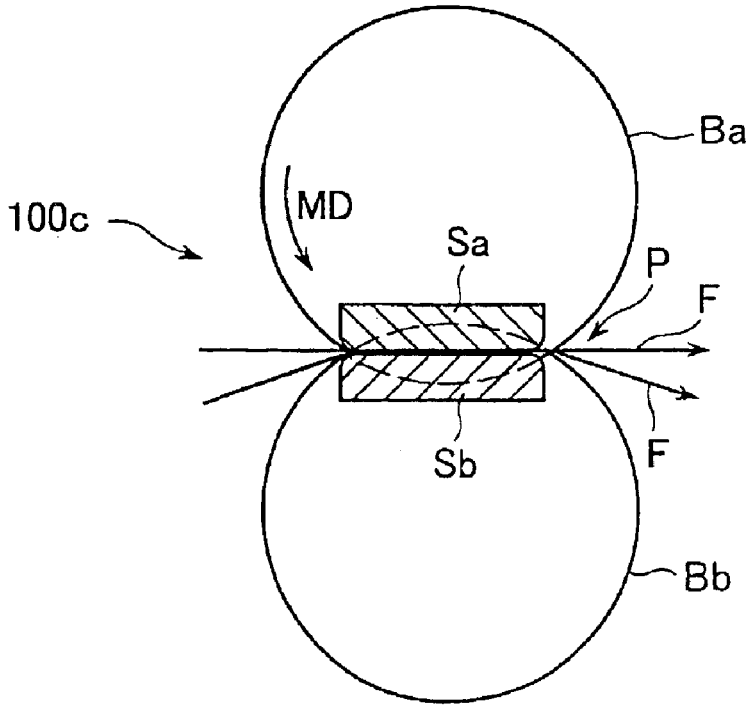
FIG. 9 is a schematic elevational view of a third conventional shoe press apparatus.
Figure 10:
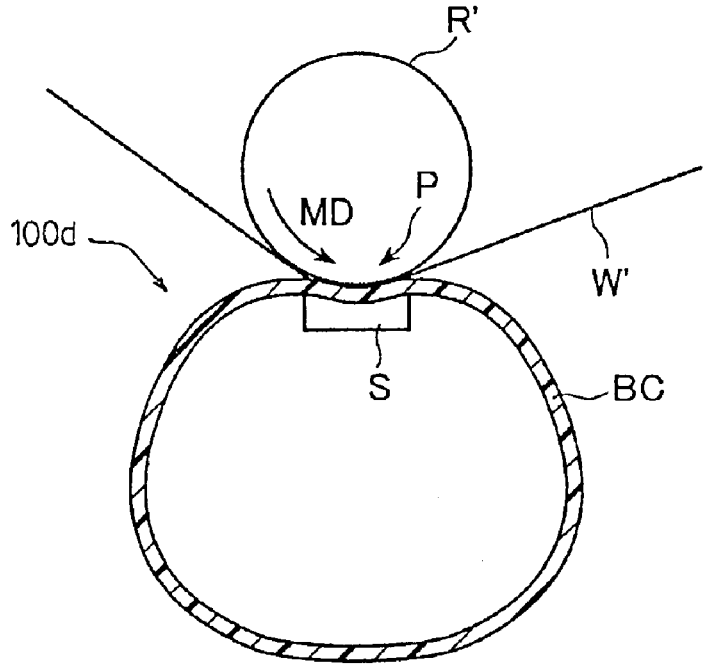
FIG. 10 is schematic elevational view of a conventional shoe press apparatus used as a calendar part of a papermaking machine.

Although the invention has been described with reference to shoe presses utilizing rolls as pressing members, the invention may be also be applied to a shoe press apparatus of the kind shown in FIG. 9, wherein the press part comprises a pair of shoes corresponding to shoes Sa and Sb. In this case, since the upper shoe corresponds to a pressing member, a lubricant holding section may be provided in a suitable position of the lower shoe. Needless to say, a lubricant holding section may also be provided on the upper shoe.

In accordance with the invention, a shoe press apparatus for a papermaking machine according to the invention can, with a comparatively simple structure, reliably supply a lubricant from the outside of a shoe to a press part.

Therefore, friction generated between a belt and the shoe can be decreased significantly , and, as a result, the energy required to drive the belt can also be decreased significantly. Moreover, since the structure is relatively simple, it can be applied to shoe presses of various structures without greatly increasing their manufacturing cost.

What is claimed is:

1. A shoe press apparatus for a papermaking machine, said shoe press apparatus having a press part which comprises a shoe, a pressing member cooperating with, and in opposed relationship to, said shoe, said shoe press apparatus further comprising a belt sandwiched in said press part between said shoe and said pressing member and movable relative to said shoe in a first direction from an upstream side of the shoe toward a downstream side of the shoe, said belt being arranged to come into contact with the shoe at a location on said upstream side, and a lubricant supply means arranged to supply lubricant to said shoe and belt on the upstream side of the shoe, wherein the improvement comprises a lubricant holding section formed in the surface of the shoe at least in part on the upstream side of said location, said lubricant holding section comprising at least one groove, each groove of the lubricant holding section being elongated in the direction of belt movement and having upstream and downstream ends, and at least a part of each groove of the lubricant holding section being provided in an area of the shoe that is not contacted by said belt.

2. A shoe press apparatus as claimed in claim 1, wherein a part of each groove of said lubricant holding section is provided in an area of the shoe that is contacted by said belt.

3. A shoe press apparatus as claimed in claim 1, wherein a part of each groove of said lubricant holding section extending to its downstream end, at least from an intermediate part thereof between its upstream and downstream ends, gradually becomes more shallow toward its downstream end.

4. A shoe press apparatus as claimed in claim 3, wherein each groove of said lubricant holding section becomes wider from the upstream end of the groove toward the downstream end of the groove.

5. A shoe press apparatus as claimed in claim 1, wherein each groove of said lubricant holding section is provided in an area of the shoe that is not contacted by said belt.

6. A shoe press apparatus as claimed in claim 5, wherein a part of each groove of said lubricant holding section extending to its downstream end, at least from an intermediate part thereof between its upstream and downstream ends, gradually becomes more shallow toward its downstream end.

7. A shoe press apparatus as claimed in claim 5, wherein each groove of said lubricant holding section becomes wider from the upstream end of the groove toward the downstream end of the groove.

8. A shoe press apparatus for a papermaking machine, said shoe press apparatus having a press part which comprises a shoe, a pressing member cooperating with, and in opposed relationship to, said shoe, said shoe press apparatus further comprising a belt sandwiched in said press part between said shoe and said pressing member and movable relative to said shoe in a first direction from an upstream side of the shoe toward a downstream side of the shoe, said belt being arranged to come into contact with the shoe at a location on said upstream side, and a lubricant supply means arranged to supply lubricant to said shoe and belt on the upstream side of the shoe, wherein the improvement comprises a lubricant holding section formed in the surface of the shoe at least in part on the upstream side of said location, said lubricant holding section comprising a multitude of minute concavities forming a satin finish on the surface of the shoe.

* * * * *